US007424887B2

(12) United States Patent
Abe

(10) Patent No.: US 7,424,887 B2
(45) Date of Patent: Sep. 16, 2008

(54) PANEL TYPE RADIATOR

(75) Inventor: Toshio Abe, Hokkaido (JP)

(73) Assignee: Kohno Company, Limited, Hokkaido (JP)

( * ) Notice: Subject to any disclaimer, the term of this patent is extended or adjusted under 35 U.S.C. 154(b) by 453 days.

(21) Appl. No.: 10/535,640

(22) PCT Filed: Nov. 28, 2002

(86) PCT No.: PCT/JP02/12435

§ 371 (c)(1),
(2), (4) Date: May 20, 2005

(87) PCT Pub. No.: WO2004/048855

PCT Pub. Date: Jun. 10, 2004

(65) Prior Publication Data

US 2006/0070619 A1 Apr. 6, 2006

(51) Int. Cl.
*F24H 1/00* (2006.01)

(52) U.S. Cl. ..... 126/357.1; 126/350.1; 126/348

(58) Field of Classification Search ..... 126/357.1, 126/350.1, 348, 91 A, 91 R
See application file for complete search history.

(56) References Cited

U.S. PATENT DOCUMENTS 1,236,353 A * 8/1917 Purcell ..... 126/91 R
1,567,404 A * 12/1925 Whitelaw et al. ..... 126/91 R
4,014,316 A * 3/1977 Jones et al. ..... 126/391.1

FOREIGN PATENT DOCUMENTS

| | | | |
|---|---|---|---|
| JP | 59-081432 | A | 5/1984 |
| JP | 62-131121 | A | 6/1987 |
| JP | 5-96767 | U | 12/1993 |
| JP | 10-002501 | A | 1/1998 |

OTHER PUBLICATIONS

Patent Abstracts of Japan, 1 page English Abstract of JP 10-002501, Jan. 1998.
Patent Abstracts of Japan, 1 page English Abstract of JP 59-081432, May 1984.
Patent Abstracts of Japan, 1 page English Abstract of JP 62-131121, Jun. 1987.
2 page English language Abstract of JP5-96767 previously submitted, Dec. 27, 1993.

* cited by examiner

*Primary Examiner*—Alfred Basichas
(74) *Attorney, Agent, or Firm*—Howson & Howson LLP

(57) ABSTRACT

The present invention relates to a panel radiator comprising a rectangular steam generation unit having a combustion unit and a heat exchange unit at the lower part thereof, characterized in that the left and right introduction pipes, each having one end coupled with the steam introduction unit, are coupled with the steam introduction unit of a radiation panel body, and a heat pipe is constituted by reducing the pressure at the steam generation unit and the panel body, whereby a small panel radiator integrated with a heating source and capable of transporting heat efficiently from a heating source to a heat radiating unit utilizing the heat pipe principle is provided thereby.

9 Claims, 2 Drawing Sheets

PANEL TYPE RADIATOR

BACKGROUND OF THE INVENTION

The present invention relates to a panel radiator to be used in indoor radiation heaters for homes, gymnasiums and the like, and in particular relates to a small panel radiator integrated with a heat source capable of transporting heat efficiently from a heating source to a heat radiating unit based on the heat pipe principle.

With a conventional hot-water or steam panel heater, a large boiler heat source unit is installed separately from the heating panel or the like, and the primary method employed is to heat the panel by circulating the heating steam or hot water through the pipe with a circulating pump or the like.

With this kind of heater, there is a problem in that, since the piping between the heat source and the heat radiation board is long, there is a significant heat radiation loss. Although this is relatively efficient in nursing homes and large hospitals that heat all the rooms and halls across the board at all times (24 hours), there is a drawback in that this is not suitable for heating small facilities.

Further, this kind of method of heating the panel by circulating the heating steam or hot water requires a high degree of air/liquid tightness, and it is necessary to properly seal the joints between the boiler heat source unit and the piping, the main pipe and branch pipe of the piping, and the piping and the panel functioning as each heat radiation board.

For example, if a part of such seal is defective, steam or the like will leak therefrom, and there is a problem in that the entire piping must be temporarily stopped for repairing the defect. When this kind of repair is made, even in a large facility such as a hospital, a serious heating crisis may occur during the winter season.

Further, when the number of panels to be connected increases, the boiler as the heat source will also become enlarged, and there is a problem in that costs for equipment and operation will also increase.

Nevertheless, a panel heater that uses a heat medium such as hot water is able to offer quiet heating based on convection without having to coercively mix the air, and, since it does not directly discharge exhaust gas (carbon dioxide) as with a portable oil heater, there is a superior advantage in that it is sanitary since the air will not be polluted.

Thus, although a small heat medium panel heater that can be installed relatively easily in any place is being sought, but the current status is that an efficient panel radiator is not yet available.

SUMMARY OF THE INVENTION

The present invention was devised in view of the foregoing problems, and an object thereof is to provide a small panel radiator integrated with a heat source and capable of transporting heat efficiently from a heating source to a heat radiating unit utilizing the heat pipe principle.

The present inventors discovered that, by improving the structure of the panel radiator, an efficient panel radiator utilizing the heat pipe principle can be obtained, and the conventional problems can be overcome as a result thereof.

Based on the foregoing discovery, the present invention provides:

1. A panel radiator comprising an oblong radiation panel body and at the lower part thereof, an oblong steam generation unit having a combustion unit and a heat exchange unit, wherein the radiation panel body and steam generation unit are respectively coupled with left and right steam introduction pipes at positions near the end portions in the length direction thereof, and a heat pipe is constituted by depressurizing the steam generation unit and panel body;
2. A panel radiator according to paragraph 1 above, wherein the left and right steam introduction pipes positioned at the upper part of the steam generation unit are coupled with the lower part of the radiation panel body;
3. A panel radiator according to paragraph 1 above, wherein one of the left and right steam introduction pipes positioned at the upper part of the steam generation unit is coupled to the lower end of the radiation panel body, and the other pipe is coupled to the upper end of the radiation panel body;
4. A panel radiator according to any one of paragraphs 1 to 3 above, wherein the radiation panel body is constituted from a plurality of tubular panel plates in communication at both ends;
5. A panel radiator according to any one of paragraphs 1 to 4 above, wherein the radiation panel body is constituted from a pair of front and back panel plates;
6. A panel radiator according to any one of paragraphs 1 to 4 above, wherein a radiation fin is provided between the pair of front and back panel plates;
7. A panel radiator according to any one of paragraphs 1 to 6 above, wherein a radiation fin is provided to the front and back of the panel plate; and
8. A panel radiator according to any one paragraphs 1 to 7 above, wherein a combustion unit is provided at one end of the rectangular steam generation unit so as to form a pressure difference in the steam generation unit based on a thermal gradient.

DETAILED DESCRIPTION OF THE INVENTION

Figure 1:
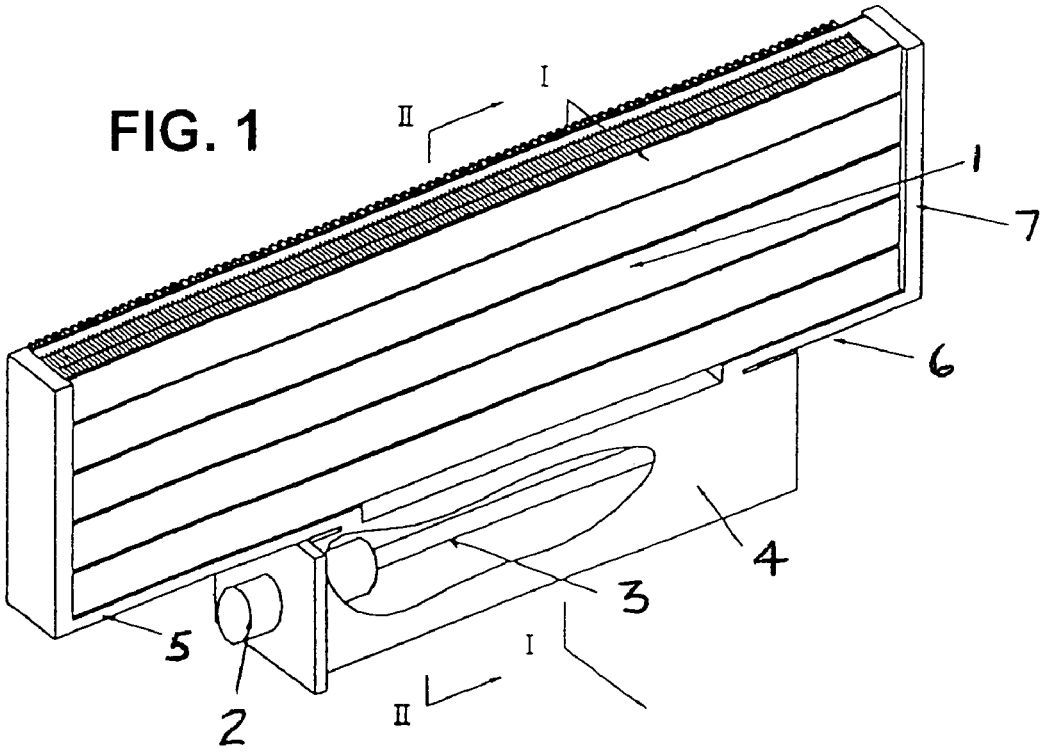
FIG. 1 is a perspective view showing the schematic of the panel radiator according to the present invention.
Figure 2:
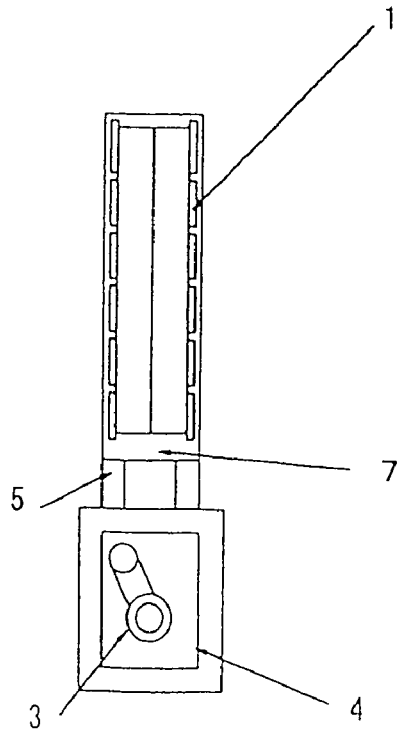
FIG. 2 is a cross section in the I-I direction shown in FIG. 1.
Figure 3:
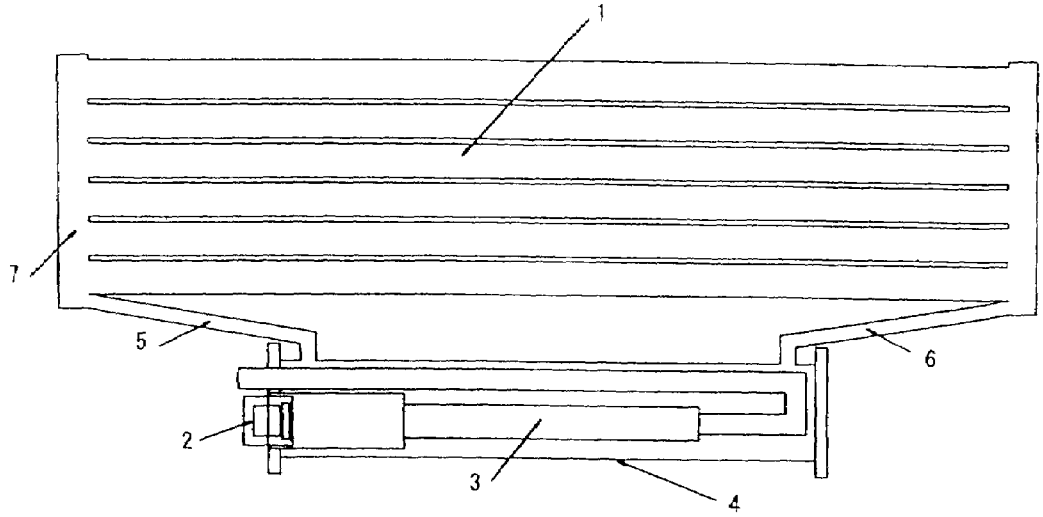
FIG. 3 is a cross section in the II-II direction shown in FIG. 1.

An example of the present invention is now explained with reference to the drawings. FIG. 1 is a perspective view showing the schematic of the panel radiator according to the present invention; FIG. 2 is a cross section in the I-I direction shown in FIG. 1; and FIG. 3 is a cross section in the II-II direction shown in FIG. 1.

The panel radiator of the present invention comprises, at the lower part thereof, a rectangular (oblong) steam generation unit 4 having a combustion unit 2 and a heat exchange unit 3, and has a compact structure that is integral with a radiation panel body 1. And, this panel radiator possesses characteristics that do not require other boiler heat source units or piping like conventional panel radiators.

The rectangular steam generation unit 4, as shown in FIG. 1, is a case extending horizontally and approximately parallel with the radiation panel body 1, and a working fluid is introduced therein. As a result of the steam generation unit 4 and radiation panel formed in such an oblong shape, a compact radiator can be obtained.

As necessary, a corrosion inhibitor or antifreezing agent may be added to this working fluid. There is no particular limitation on the material of the working fluid, and any conventional working fluid may be used. Although it is standard to use water, which the nature thereof is well known, it is desirable to use something with a low chlorine component.

The constitution may be such that the combustion unit 2 is built in the steam generation unit 4, or may be provided separately from the steam generation unit 4, and, when it is built in, there is an advantage in that the panel radiator can be made more compact. There is no particular limitation on the shape of this combustion unit 2, and a conventional heating device may also be used.

A heating pipe is disposed in the steam generation unit 4 and the working fluid is heated to realize the heat exchange unit 3. In the drawings, the heating pipe is formed in a U-shape, and constituted to return the exhaust gas in the reverse direction. Nevertheless, there is no particular limitation on this constitution, and a publicly known constitution may be used so as long as it is able to heat the working fluid efficiently. For example, a direct tubular combustion heating system may be employed.

The left and right introduction pipes 5, 6 coupled with the upper end of the rectangular steam generation unit 4 are coupled with the steam introduction unit of the radiation panel body 1. A steam introduction header 7 is provided to the left and right sides of the radiation panel body 1.

The inside of the steam generation unit 4 and panel body 1 is subject to vacuuming and depressurization so as to constitute a heat pipe. The working fluid heated with the combustion unit of the steam generation unit 4 becomes steam, this steam is introduced into the steam introduction header 7 via the steam introduction pipes 5, 6, and this further spreads to the panel body 1 and radiates heat.

Although the panel body 1 is constituted from a plurality of tubular panel plates in which both ends thereof are usually in communication, the cross section of the respective tubular panel plates will be an elongated (flat) elliptic shape. Nevertheless, although there is no particular limitation on the cross section of each tubular panel plate, if the foregoing shape is employed, there is an advantage in that the panel radiator can be made compact, and heat radiation can be conducted efficiently.

High temperature combustion gas generated by the combustion of a burner or the like in the combustion unit 2 will be subject to a heat exchange with the working fluid in the heat exchange unit 3, and generate the steam of the working fluid. The steam generated here is introduced to the steam introduction header 7 via the introduction pipes 5, 6 and will further spread to the panel body 1, and the working fluid will become condensed, release the latent heat of vaporization, and return to a liquid.

Here, based on the depressurization caused by the liquid return occurring in the panel body 1 and the pressure increase caused by the evaporation of the steam generation unit 2, the steam will continue to be introduced in the panel body 1.

As shown in FIG. 1 and FIG. 3, the left and right steam introduction pipes 5, 6 of the steam generation unit 4 are coupled with lower end of the radiation panel body 1; that is, the steam introduction header, and the working fluid that returned to a liquid in the panel body 1 usually returns to the steam generation unit 2 via the introduction pipes 5, 6.

As shown in FIG. 1, when the combustion unit 2 is provided to one end of a rectangular (cuboid) steam generation unit, the hot section shown in FIG. 1 or FIG. 3 will be on the left side of the steam generation unit 4, and the right side that is somewhat farther from the combustion unit 2 will become a relatively low temperature section, and this will form a pressure difference based on the thermal gradient in the steam generation unit.

Therefore, the side of the introduction pipe 5 will be the main introduction unit of the steam, and the side of the other introduction pipe 6 will be the main side for liquid return. As a result, the introduction of steam and the efficiency of liquid return will increase, and the introduction of steam to the panel body 1 will be accelerated and uniform.

Therefore, the constitution where the steam generation unit 4 is a rectangular case (cuboid) extending horizontally, and the left and right introduction pipes 5, 6 near both ends thereof being coupled to the lower end of the steam introduction header of the radiation panel body 1 is important upon performing efficient heat exchange, or heat radiation.

Incidentally, in the foregoing constitution, since the left and right introduction pipes are released, although a small amount, either pipe may become the introduction unit or liquid return unit of the steam.

Figure 4:
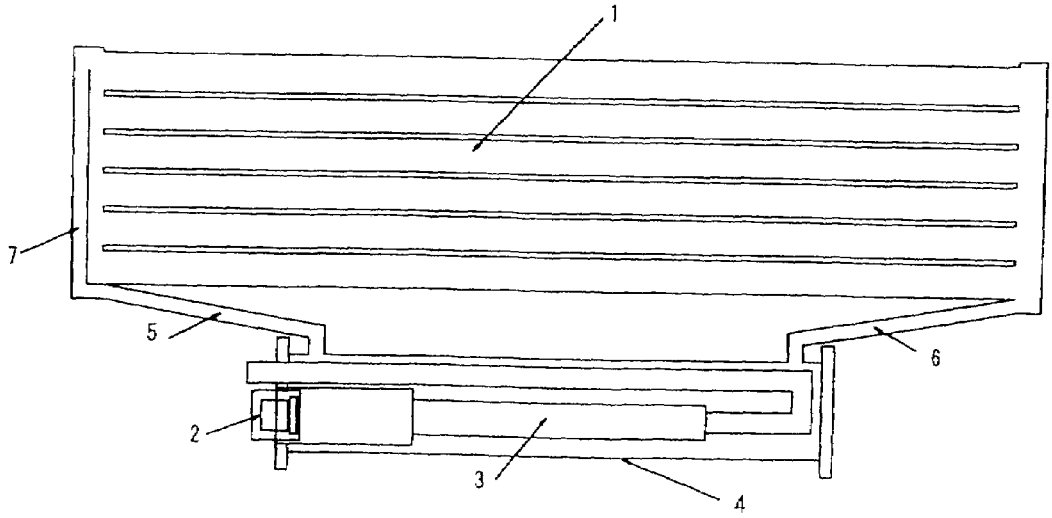
FIG. 4 is a cross section of the panel radiator showing another example of the present invention having a constitution wherein one of the left and right introductions pipes of the steam generation unit is coupled to the lower end of the radiation panel body, and the other pipe is coupled to the upper end of the panel body.

Further, as shown in FIG. 4, a constitution where one of the left and right introduction pipes 5, 6 of the steam generation unit is coupled with the lower end of the radiation panel body 1, and the other pipe; that is, the steam introduction header 7 on the side of the steam generation unit 4 (hot section) being coupled with the upper end of the panel body 1 may also be employed.

Here, a significant effect is yielded in that hot steam is introduced from the steam introduction header 7 of the introduction pipe 5 on to the panel body 1, steam will be sent all across the panel body 1, the working fluid will be become condensed, release the latent heat of vaporization, return to liquid, and thereafter the introduction pipe 6 side will become the liquid return side, the efficiency of the introduction of steam and liquid return will increase, and the introduction of steam to the panel body 1 will be accelerated and uniform.

This radiation panel body 1 may also be a pair of front and back panel plates, or a plurality of panel plates. The installation of these panel plates may be changed according to the panel radiator capacity and scale of heating performance.

Further, a radiation fin may be provided between the front and back panel plates or between the plurality of panel, and provided to the front and back of the panel plate. This configuration may also be changed according to the panel radiator capacity and scale of heating performance.

When providing a radiation fin between the pair of front and back panel plates, there is an advance in that the panel radiator can be made more compact.

The panel radiator of the present invention is characterized in that the steam generation unit having a combustion unit and heat exchange unit built therein, and the panel body being directly coupled without going through piping or the like, and this in itself constitutes an independent radiator, and the equipment cost can be reduced while the heat exchange efficiency can be significantly improved compared to a conventional heating device based on the circulation of hot water or steam.

Further, the panel radiator can be miniaturized, exchange or installation of the heating device can be conducted extremely easily, and a highly secure panel radiator is obtained thereby.

Further, the efficiency of the panel radiator can be improved by adopting the constitution of making the steam generation unit a rectangular case (cuboid) extending horizontally, and coupling the left and right introduction pipes near both ends thereof with the left and right lower ends of the radiation panel body; that is, the steam introduction header, or coupling one pipe to the upper end thereof, one introduction pipe can be made to be main introduction unit of the steam, and the other introduction pipe can be made to be the main liquid return side so as to increase the efficiency of the introduction of steam and liquid return, the introduction of steam to the panel body 1 can be accelerated and made uniform.

The invention claimed is:

1. A panel radiator, comprising:

an oblong radiation panel body having upper and lower ends; and an oblong, rectangular steam generation unit that has a length shorter than a length of said radiation panel body and that is located on a lower part of said radiation panel body, said steam generation unit having a combustion unit and a heat exchange unit, said combustion unit adapted to directly heat a liquid working fluid and being provided on one side of said rectangular steam generation unit to permit a pressure difference to be formed in said steam generation unit based on a thermal gradient;

left and right steam introduction pipes on an upper end of said steam generation unit respectively coupled with a lower end of left and right steam introduction headers of said radiation panel body, one of said left and right steam introduction headers opening into said lower end of said radiation panel body and the other one opening only into said upper end of said radiation panel body, said steam introduction header opening only into said upper end of said radiation panel body extending from said side of said rectangular steam generation unit in which said combustion unit is provided; and a heat pipe constituted by the steam generation unit and panel body upon depressurization.

2. A panel radiator according to claim 1, wherein said radiation panel body includes a pair of front and back panel plates.

3. A panel radiator according to claim 2, wherein a radiation fin is provided between said pair of front and back panel plates.

4. A panel radiator according to claim 2, wherein a radiation fin is provided on the front and back of said panel plates.

5. A panel radiator according to claim 1, wherein said radiation panel body includes a plurality of tubular panel plates in communication at both ends.

6. A panel radiator according to claim 5, wherein a radiation fin is provided on the front and back of said panel plates.

7. A panel radiator according to claim 5, wherein said radiation panel body includes a pair of front and back panel plates.

8. A panel radiator according to claim 7, wherein a radiation fin is provided on the front and back of said panel plates.

9. A panel radiator, comprising:

an oblong radiation panel body having upper and lower ends and steam introduction headers on opposite sides; and an oblong steam generation unit located adjacent said lower end of said radiation panel body and having a combustion unit and a heat exchange unit extending therein, said combustion unit adapted to directly heat a liquid working fluid and being provided in one side of said oblong steam generation unit to form a pressure difference in said steam generation unit based on thermal gradient; and steam introduction pipes extending from opposite sides of said steam generation unit respectively coupled with said steam introduction headers of said radiation panel body;

one of said steam introduction headers opening into said lower end of said radiation panel body and the other one of said steam introduction headers opening only into said upper end of said radiation panel body, said steam introduction header opening only into said upper end of said radiation panel body extending from said side of said rectangular steam generation unit in which said combustion unit is provided; and said oblong steam generation unit having a length shorter than a length of said oblong radiation panel body, and said steam generation unit and panel body constituting a heat pipe upon depressurization.

* * * * *